US006161925A

United States Patent [19]

Reinten et al.

[11] Patent Number: 6,161,925

[45] Date of Patent: Dec. 19, 2000

[54] INK JET NOZZLE HEAD WITH BACKING MEMBER

[75] Inventors: Hans Reinten, Velden; Peter Joseph Hollands, Baarlo, both of Netherlands

[73] Assignee: Oce' Technologies B.V., Venlo, Netherlands

[21] Appl. No.: 08/896,065

[22] Filed: Jul. 17, 1997

[30] Foreign Application Priority Data

Jul. 18, 1996 [EP] European Pat. Off. ..... 96202043

[51] Int. Cl.[7] ..... B41J 2/045

[52] U.S. Cl. ..... 347/70

[58] Field of Search ..... 347/70, 71, 72, 347/10, 11; 29/890.1

[56] References Cited

U.S. PATENT DOCUMENTS 5,761,783 6/1998 Osawa et al. ..... 347/70

FOREIGN PATENT DOCUMENTS

0402172 A1 12/1990 European Pat. Off. .
0402172 B1 12/1990 European Pat. Off. .
0721839 A2 7/1996 European Pat. Off. .

OTHER PUBLICATIONS

Minoru, et al, English–language abstract of Japanes patent JP–A–3–221458.
Kenji, English–language abstract of Japanese patent JP–A–7–3146712.
Toshio, et al, English–language abstract of Japanese patent JP–A–7–081058.

*Primary Examiner*—John Barlow
*Assistant Examiner*—Juanita Stephens

[57] ABSTRACT

An ink jet nozzle head including a channel plate defining a linear array of equidistanced nozzles and a plurality of substantially parallel ink channels communicating with an associated nozzle, a vibration plate disposed on the channel plate, a plurality of separately disposed block members, each containing a comb-like array of fingers which extend toward and engage the vibration plate, some fingers functioning as actuators for exerting mechanical pressure on ink contained in the ink channels, which in turn expels ink droplets from the nozzles, at least one actuator being provided for each nozzle, and the other fingers serving as support members, backing means mechanically interconnecting the actuators and support members, the support members supporting the channel plate and the backing means against the reaction forces of the actuators, the backing means comprising a separate backing member disposed over said array of fingers and being more flexible in the transverse direction of the ink channels than in the longitudinal direction thereof.

14 Claims, 3 Drawing Sheets

INK JET NOZZLE HEAD WITH BACKING MEMBER

BACKGROUND AND SUMMARY OF THE INVENTION

The present invention relates to a nozzle head for use in an ink jet printer.

A nozzle head having the features specified in the preamble of claim 1 is disclosed in EP-A-0 402 172. This nozzle head comprises a channel plate defining a linear array of equidistant nozzles and a plurality of parallel ink channels, each connected to a respective one of the nozzles. On one side of the channel plate there is disposed an array of elongate fingers projecting towards the nozzle plate and extending in parallel with the ink channels. The ends of these fingers facing away from the channel plate are interconnected by a bridge portion which is formed integrally with the fingers. The fingers and the bridge portion are made of a piezoelectric ceramic material. Every second finger is provided with electrodes and serves as an actuator which, when a print signal is applied to the electrodes, compresses the ink liquid contained in the associated ink channel, so that an ink droplet is expelled from the nozzle. The other fingers intervening between the actuators serve as support members which rigidly connect the channel plate to the bridge portion, so that latter may function as a backing means for receiving the reaction forces generated by the actuators.

Since a support member is provided between each pair of consecutive actuators, each actuator is substantially shielded against the reaction forces from its neighbors, so that undesired cross-talk between the various channels is reduced.

However, when one of the actuators is activated, e.g. expanded, the support members adjacent thereto on both sides are elastically deformed to some extent, so that the bridge portion is slightly deflected. This effect becomes more significant when a plurality of neighboring actuators are activated simultaneously, whereby the stresses applied to the bridge portion are accumulated. In this case the deformation of the bridge portion will also affect the actuators which are disposed at a comparatively large distance from the active actuators and will cause the generation of parasitic acoustic waves in the ink channels where no droplets are to be expelled. Thus, there exists a problem which can be termed "long-range cross-talk."

It is an object of the present invention to provide a nozzle head in which long-range cross-talk can be suppressed more efficiently. According to the present invention, the backing means comprise a separate backing member disposed over the array of fingers, said backing member being more flexible in the transverse direction of the ink channels than in the longitudinal direction thereof.

As a result, the reaction force of each of the actuators of one block is mainly absorbed by the directly adjacent support members, whereby the mechanical coupling between actuators separated by a large distance is reduced due to the flexibility of the backing member. Thus, the undesired long-range cross-talk phenomenon is substantially eliminated.

In addition, the manufacture of the array of fingers and of the backing means is facilitated, because only the actuators have to be made of a piezoelectric material whereas the material of the separate backing member may be selected as desired in order to optimize the mechanical properties thereof. Moreover, part of the electrodes needed for energizing the actuators can be arranged at the boundary between the actuators and the backing member, so that the electrodes can easily be disposed at appropriate positions relative to the actuators and/or the pattern of electrical leads for energizing the electrodes is simplified.

The ends of the fingers (actuators and support members) adjacent to the backing member may still be interconnected by relatively thin bridge portions formed integrally with the fingers. Alternatively, the fingers may be separated completely so that they are interconnected only by the backing member disposed thereon.

The unisotropic flexibility characteristic of the backing member can be achieved for example by providing a plate with a suitable profile on the side opposite to the array of fingers.

In a preferred embodiment, the backing member has a grid-like structure and comprises a plurality of beams extending in the longitudinal direction of the ink channels. Preferably, the width of the beams is made so large that each beam supports only a few fingers, i.e. at least one support member and at least one actuator. Thus, the reaction force of an actuator is transmitted to the neighboring support member (s) via the associated beam, without causing a substantial displacement of the neighboring beams and the actuators supported thereby.

The backing member may further comprise transverse beams interconnecting the ends of the longitudinal beams, thereby stabilizing the longitudinal beams against tilting movements about their longitudinal axis.

In a particularly preferred embodiment, the array of fingers is formed by a number of separate blocks each of which comprises only a few fingers integrally connected with each other and supported by a common beam. Each block advantageously comprises only one support member and only one or two actuators, so that the spatial relationship between the actuators and the associated support members is the same for all actuators (except for mirror symmetry in the case of two actuators disposed on opposite sides of the support member). Then, the support structure for the various actuators will not cause any differences in the performance and mechanical behavior of the actuators in the process of droplet generation.

An efficient method for manufacturing a nozzle head of the type discussed hereinabove comprises bonding a comparatively thick layer of piezoelectric material to a surface of an essentially plate-like member, which will later form the backing member. Then, an array of fingers is formed by cutting parallel grooves into a layer of piezoelectric material. The depth of the grooves separating individual fingers of the same block is made smaller than the thickness of the layer of piezoelectric material, whereas the grooves which are to separate the blocks from each other are cut to a greater depth so that they extend into the backing member, thereby dividing the backing member into separate beams.

BRIEF DESCRIPTION OF THE DRAWINGS

Preferred embodiments of the invention will now be described in conjunction with the accompanying drawings, in which.

DETAILED DESCRIPTION OF THE INVENTION

Figure 1:
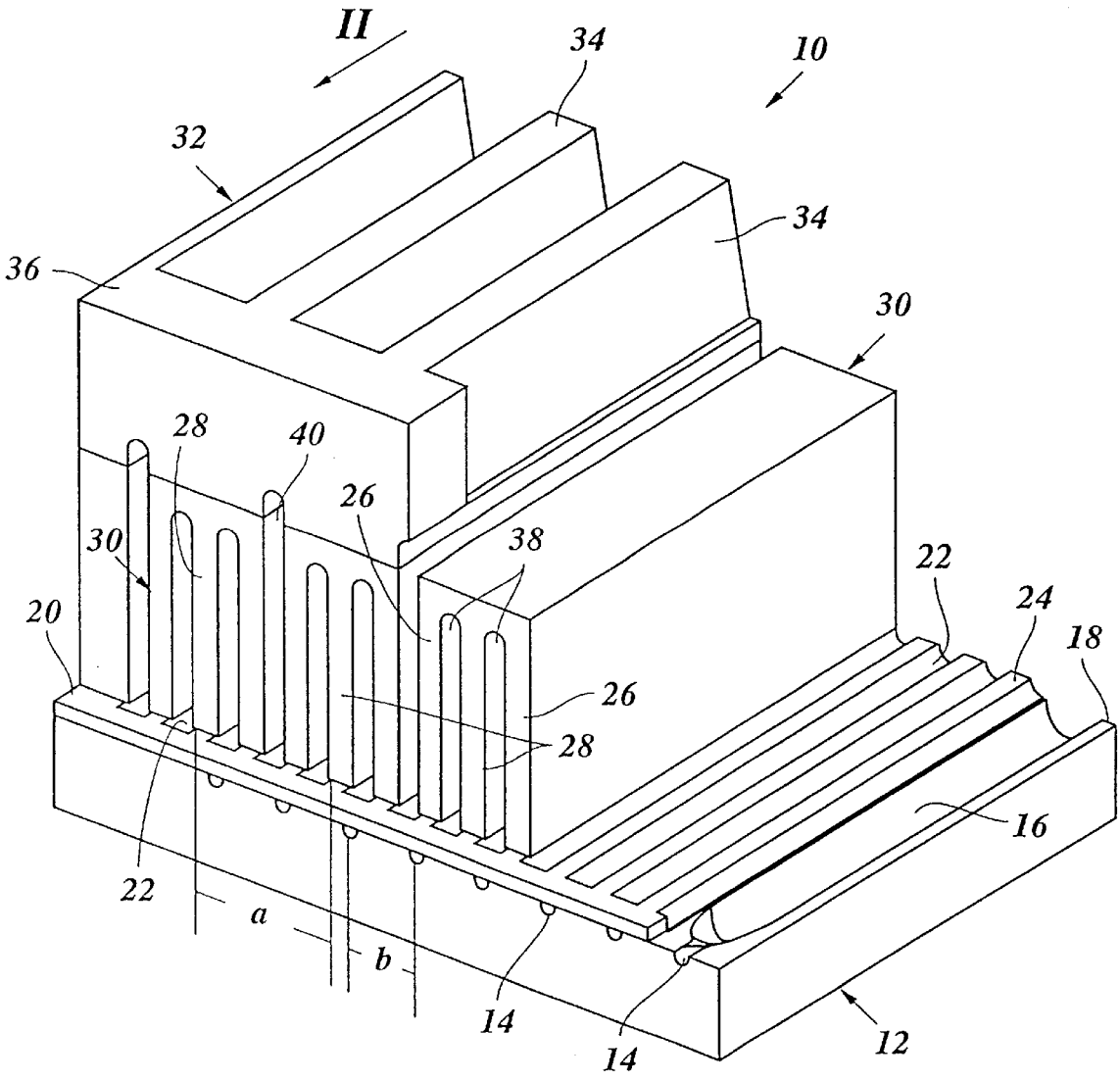
FIG. 1 is a partly broken-away perspective view of a nozzle head according to a first embodiment of the invention.
Figure 2:
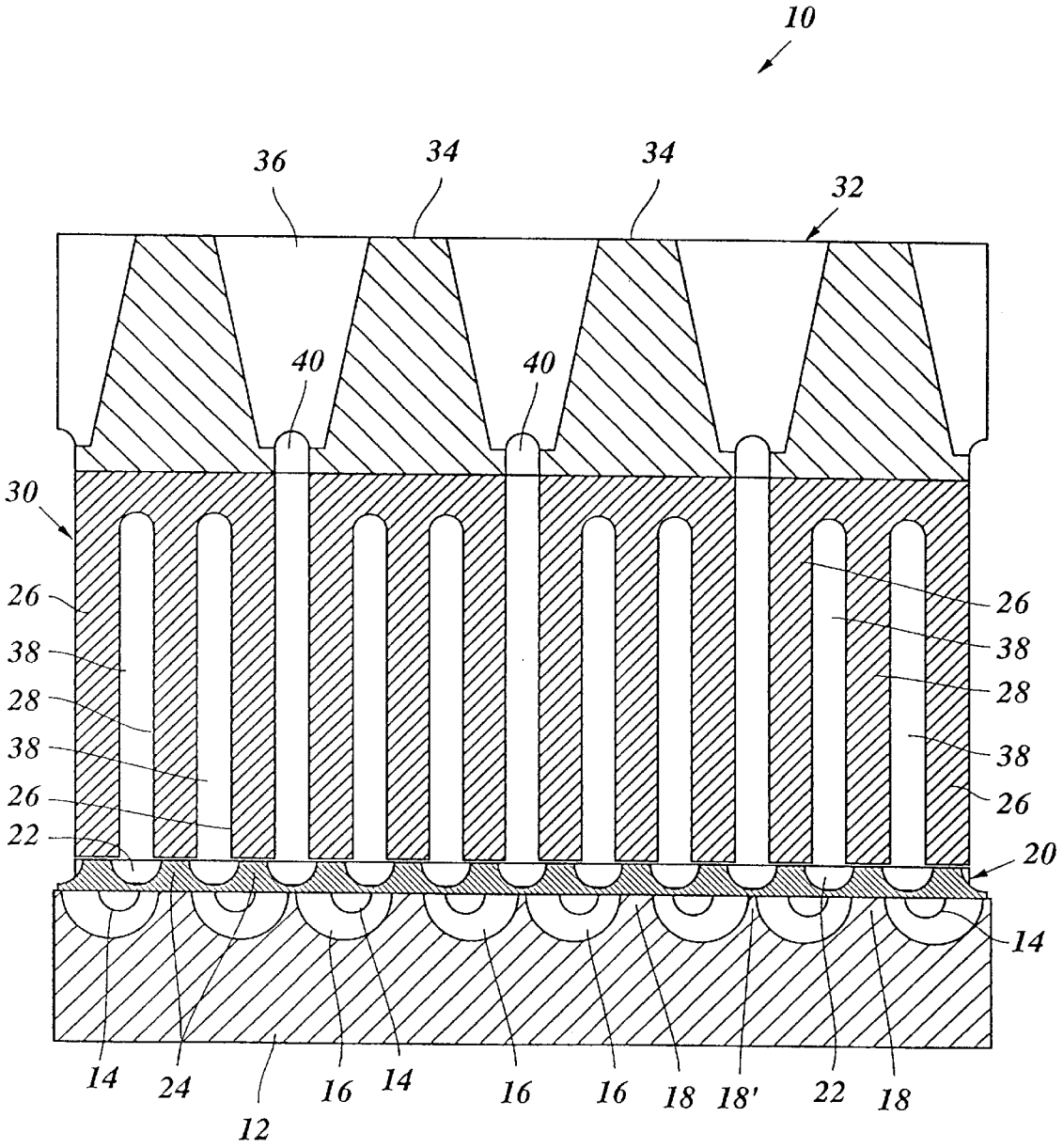
FIG. 2 is a cross-sectional view in the direction of the arrow II in FIG. 1.

The nozzle head 10 illustrated in FIGS. 1 and 2 comprises a channel plate 12 which defines a linear array of nozzles 14 and a number of parallel ink channels 16, only one of which is shown in FIG. 1. The nozzles 14 and the ink channels 16 are formed by grooves cut into the top surface of the channel plate 12. Each nozzle 14 is connected to an associated ink channel 16. The ink channels are separated by dam portions 18, 18'.

The top sides of the nozzles 14 and the ink channels 16 are closed by a thin vibration plate 20, which is securely bonded to the dam portions of the channel plate.

The top surface of the vibration plate 20 is formed with a series of grooves 22 which extend in parallel with the ink channels 16 and are separated by ridges 24. The ends of the grooves 22 adjacent to the nozzles 14 are slightly offset from the edge of the vibration plate 20.

An array of elongate fingers 26, 28 is disposed on the top surface of the vibration plate 20 such that each finger extends in parallel with the ink channels 16 and has its lower end fixedly bonded to one of the ridges 24. The fingers are grouped in triplets, each triplet consisting of a central finger 28 and two lateral fingers 26. The fingers of each triplet are interconnected at their top ends and are formed by a one-piece block 30 of piezoelectric material.

Each of the fingers 26 is associated with one of the ink channels 16 and is provided with electrodes (not shown) to which an electric voltage can be applied in accordance with a printing signal. These fingers 26 serve as actuators which expand and contract in the vertical direction in response to the applied voltage, so that the corresponding portion of the vibration plate 20 is deflected into the associated ink channel 16. As a result, the ink liquid contained in the ink channel (e.g. a hot-melt ink) is pressurized and an ink droplet is expelled from the nozzle 14.

The central fingers 28 are disposed over the dam portions 18 of the channel plate and serve as support members which absorb the reaction forces of the actuators 26. For example, if one or both actuators 26 belonging to the same block 30 are expanded, they exert an upwardly directed force on the top portion of the block 30. This force is largely counterbalanced by a tension force of the support member 28 the lower end of which is rigidly connected to the channel plate 12 via the ridge 24 of the vibration plate.

The top ends of the blocks 30 are flush with each other and are overlaid by a backing member 32. The backing member 32 is formed by a number of longitudinal beams 34 extending in parallel with the ink channels 16 and by transverse beams 36 which interconnect with the ends of the longitudinal beams 34 (only one of the transverse beams is shown in FIG. 1).

The longitudinal beams 34 have a trapezoidal cross section and are originally interconnected with each other at their broader base portions, so that they form a continuous plate. In a subsequent manufacturing step, a comparatively thick layer of piezoelectric material which will later form the blocks 30 is bonded to the plate, i.e. to the lower surface of the backing member 32 in FIG. 1. Then, the blocks 30 and the fingers 26, 28 are formed by cutting grooves 38, 40 into the piezoelectric material. While the grooves 38 which separate the fingers 26 and 28 terminate within the piezoelectric material, the grooves 40 separating the blocks 30 are cut into the backing member 32, thereby separating the longitudinal beams 34 from one another.

Thus, the width of the longitudinal beams 34 is essentially equal to the width of the individual blocks 30. As a consequence, the beams 34 efficiently prevent an elastic deformation of the top portions of the blocks 30 when the actuators 26 expand and contract.

Since the support members 28 inevitably have a certain elasticity, expansion of one or both actuators 26 of one of the blocks 30 will also cause a minor expansion of the support members 28 and will tend to cause a slight deflection of the backing member 32. If the backing member were a non-profiled flat plate, this deflective force would be transmitted to the neighboring blocks 30 and would lead to the generation of parasitic acoustic waves in the neighboring ink channels thereby creating what is known as cross-talk. Such long-range cross-talk may cause problems, especially when a large number of actuators in neighboring blocks 30 are energized simultaneously. However, since the backing member 32 is formed by separate beams 34 which are only interconnected at their opposite ends by the transverse beams 36, and these transverse beams are additionally weakened by the grooves 40, the deflective forces are substantially confined to the blocks from which they originate. Thus, the long-range cross-talk phenomenon can be effectively suppressed.

The subdivision of the array of fingers 26, 28 into separate blocks 30 each consisting of only three fingers also facilitates the further suppression of short range cross-talk, i.e. cross-talk between the ink channels associated with the same block 30. To this end, it is sufficient to make a distinction between two cases: (a) only one of the two actuators 26 is energized; (b) both actuators are energized. In the (b) case, the support member 28 will be subject to a larger elastic deformation than in the (a) case. This effect can easily be compensated by slightly increasing the voltage applied to the actuators in the (b) case. It should be noted that this measure will not lead to an increased long-range cross talk, because the blocks 30 are separated from each other.

In the (a) case, the top portion of the block 30 and the beam 34 will be caused to slightly tilt about the top end of the support member 28, thereby compressing the ink in the neighboring channel. However, this effect will be very small due to the stabilizing effect of the transverse beams 36. If necessary, this minor effect can also be compensated for by applying a small compensation voltage with appropriate polarity to the actuator associated with the non-firing channel.

Since the support members 28 are made of a piezoelectric material, it is also possible to provide additional electrodes for the support members 28 in order to actively counterbalance the reaction forces of the actuators 26.

In the shown embodiment, the width of the grooves 40 is identical to the width of the grooves 38, and the fingers 26, 28 are equidistantly arranged. The pitch "a" of the support members 28 is larger than the pitch "b" of the nozzles 14 by a factor 2. Since every third finger is an actuating member 26, the pitch of the fingers 26, 28 is 2b/3, in comparison to a pitch of b/2 for the conventional case in which a support member is provided between each pair of adjacent ink channels. As a result, the pitch "b" of the nozzles and hence the resolution of the print head can be made small without exceeding the limits imposed by the manufacturing process for the piezoelectric actuators and support members.

In a practical embodiment the pitch "b" of the nozzles 14 may be as small as 250 m (i.e. four nozzles per millimeter). The pitch of the support members 28 will accordingly be 500 m, and the pitch of all the fingers (including the actuators 26) will be 167 m. In this case, the width of each individual finger 26 or 28 may for example be 87 m, and the grooves 38, 40 will have a width of 80 m and a depth in the order of 0.5 mm.

FIG. 2 shows the grooves 22 and ridges 24 of the vibration plate 20. The nozzles 14 and the ink channels 16 are not evenly distributed over the length of the nozzle array. Instead, the ink channels 16 are grouped in pairs separated by comparatively broad dam portions 18, whereas the ink channels of each pair are separated by a comparatively narrow dam portion 18'. The broad dam portions 18 coincide with the ridges 24 of the vibration plate and with the support members 28, whereas the smaller dam portions 18' coincide with the grooves 22 of the vibration plate and the grooves 40 between the blocks 30. The width of the ink channels 16 (at the top surface of the channel plate 12) is larger than the width of the fingers 26, 28, and the ink channels are offset relative to the nozzles 14 to such an extent that none of the actuators 26 overlaps with the dam portions 18, 18'.

The portions of the vibration plate 20 on both sides of the ridges 24 which are held in contact with the actuators 26 are weakened by the grooves 22, and at least a major part of these weakened portions is still within the area of the ink channels 16. Thus, the vibration plate 20 can be readily flexed into the in channel 16 in response to expansion strokes of the actuators 26. The width of the ridges 24 is slightly smaller than that of the fingers 26, 28.

With the above configuration, excessive bending or shearing stress in the vibration plate 20 near the edges of the dam portions 18, 18' is avoided, so that a high durability of the vibration plate 20 can be achieved.

The vibration plate 20 may be formed by a relatively soft resin foil, e.g. a soft foil of a polyimide resin, which is welded to the channel plate 12 and the to ends of the fingers 26, 28. Alternatively, the vibration plate may be formed by a thin film of glass or a metal, e.g. aluminum, which is soldered to the channel plate and the fingers.

While a specific embodiment of the invention has been described above, it will be obvious to a person skilled in the art that various modifications can be made which would fall within the spirit and scope of the invention.

For example, the width of the actuators 26 may be different from that of the support members 28. Likewise, the width of the grooves 40 may be different from that of the grooves 38, resulting in an uneven distribution of the fingers 26, 28.

Figure 3:
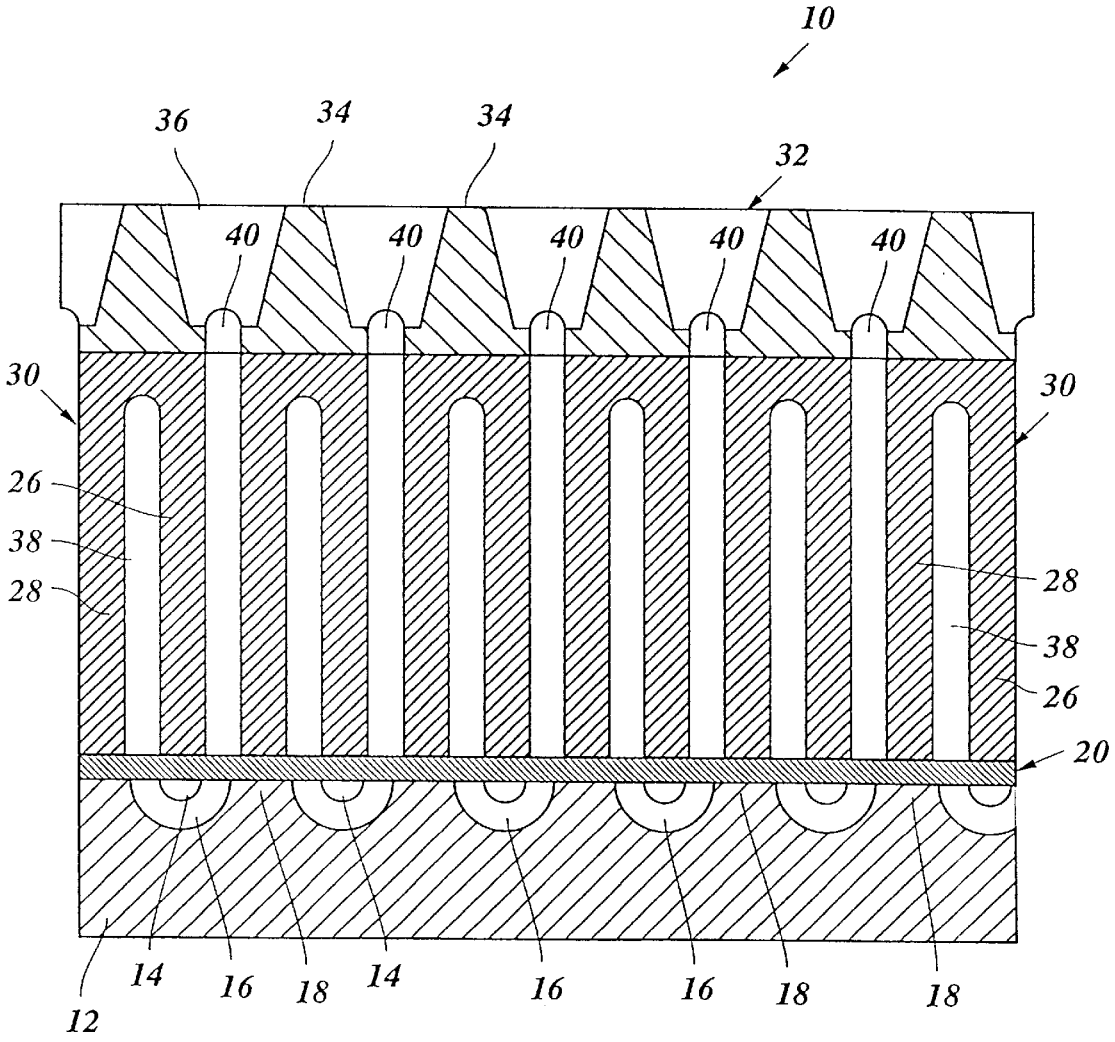
FIG. 3 is a view similar to FIG. 2 but showing a second embodiment of the present invention.

FIG. 3 shows an embodiment in which there is a one-to-one relationship between the support members 28 and the nozzles 14, and each block 30 consists only of two fingers, i. e. one support member 28 and one actuator 26. The ink channels 16 are arranged equidistantly, without being offset relative to the corresponding nozzles 14. Also, the vibration plate 20 has a uniform thickness. The width of the beams 34 is again adapted to that of the blocks 30.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet nozzle head comprising:

a channel plate defining a linear array of equidistanced nozzles and a plurality of substantially parallel ink channels communicating with an associated nozzle, a vibration plate disposed on said channel plate, a plurality of separately disposed block members, each containing a comb-like array of fingers which extend toward and engage said vibration plate, some fingers functioning as actuators for exerting mechanical pressure on ink contained in ink channels, which in turn expels ink droplets from the nozzles, at least one actuator being provided for each nozzle, and other of said fingers serving as support members, and a backing means for mechanically backing and interconnecting the actuators and support members, said support members supporting the channel plate and the backing means against reaction forces of the actuators, said backing means comprising a separate backing member disposed over said array of fingers and being more flexible in a transverse direction of the ink channels than in a longitudinal direction thereof, said backing member containing a plurality of grooves which define a plurality of separate beams which extend in a longitudinal direction of the ink channels.

2. The nozzle head of claim 1, wherein the ends of the longitudinal beams are interconnected by a transverse beam.

3. The nozzle head of claim 2, wherein each longitudinal beam extends widthwise over at least one support member and at least one actuator.

4. The nozzle head of claim 3, wherein the support members and the actuators associated with a common beam are formed by a one-piece block.

5. The nozzle head of claim 1, wherein each longitudinal beam extends widthwise over at least one support member and at least one actuator.

6. The nozzle head of claim 5, wherein each longitudinal beam extends over one support member and at least one actuator.

7. The nozzle head of claim 5, wherein the support members and the actuators associated with a common beam are formed by a one-piece block.

8. The nozzle head according to claim 7, wherein the fingers are separated by grooves, the grooves disposed between fingers of the same block having a smaller depth than the grooves which separate different blocks.

9. The nozzle head of claim 8, wherein the grooves separating the blocks extend into the backing member.

10. The nozzle head of claim 1, wherein the longitudinal beams have a trapezoidal cores section with a broader base facing towards the fingers.

11. The ink jet nozzle head of claim 1, wherein the separately disposed block members are separated by grooves which extend into the backing member.

12. The ink jet nozzle head of claim 1, wherein the plurality of grooves extend through the backing member from one side to the other side thereof.

13. An ink jet printer utilizing an ink jet nozzle head comprising:

a channel plate defining a linear array of equidistanced nozzles and a plurality of substantially parallel ink channels communicating with an associated nozzle, a vibration plate disposed on said channel plate, a plurality of separately disposed block members, each containing a comb-like array of fingers which extend toward and engage said vibration plate, some fingers functioning as actuators for exerting mechanical pressure on ink contained in the ink channels, which in turn expels ink droplets from the nozzles, at least one actuator being provided for each nozzle, and other of said fingers serving as support members, and a backing means for mechanically backing and interconnecting the actuators and support member, said support members supporting the channel plate and the backing means against reaction forces of the actuators, said backing means comprising a separate backing member disposed over said array of fingers and being more flexible in transverse direction of the ink channels than in a longitudinal direction thereof, said backing member containing a plurality of grooves which define a plurality of separate beams which extend in the longitudinal direction of the ink channels.

14. A method of manufacturing an ink jet nozzle head having a channel plate defining a linear array of equidistanced nozzles and a plurality of substantially parallel ink channels communicating with an associated nozzle, a vibration plate disposed on said channel plate, a plurality of separately disposed block members, each containing a comb-like array of fingers which extend toward and engage said vibration plate, some fingers functioning as actuators for exerting mechanical pressure on ink contained in ink channels, which in turn expels ink droplets from the nozzles, at least one actuator being provided for each nozzle, and other of said fingers serving as support members, and a backing means for mechanically backing and interconnecting the actuators and support members, said support members supporting the channel plate and the backing means against reaction forces of the actuators, said backing means comprising a separate backing member disposed over said array of fingers and being more flexible in a transverse direction of the ink channels than in a longitudinal direction thereof, said method comprising the steps of:

providing a plate-like blank for the backing member, profiling said blank to form a beam structure but having a continuous flat surface on one side thereof, bonding said block member made of a piezoelectric material for forming the actuators to a flat surface of the blank for forming the actuators, and cutting grooves into a layer of piezoelectric material, thereby forming the array of fingers, wherein some of the grooves are cut to such a depth that they extend into the blank, thereby separating the beams from one another.

* * * * *